United States Patent [19]

Yuasa et al.

[11] 4,107,572

[45] Aug. 15, 1978

[54] TRAVELING-WAVE TUBE HAVING PHASE VELOCITY TAPERING MEANS IN A SLOW-WAVE CIRCUIT

[75] Inventors: Yoshio Yuasa; Yosihiro Morizumi; Ryuzo Orui, all of Tokyo, Japan

[73] Assignee: Nippon Electric Co., Ltd., Tokyo, Japan

[21] Appl. No.: 787,359

[22] Filed: Apr. 14, 1977

[30] Foreign Application Priority Data

Apr. 16, 1976 [JP] Japan ..... 51-43195

[51] Int. Cl.[2] ..... H01J 25/34

[52] U.S. Cl. ..... 315/3.6; 315/3.5; 315/39.3

[58] Field of Search ..... 315/3.5, 3.6, 39.3

[56] References Cited

U.S. PATENT DOCUMENTS

| | | | |
|---|---|---|---|
| 3,324,342 | 6/1967 | Eallonardo | 315/3.6 |
| 3,433,992 | 3/1969 | Tancredi et al. | 315/3.6 |
| 3,614,517 | 10/1971 | Dionne | 315/3.6 |
| 3,678,326 | 7/1972 | Heynisch | 315/3.6 |
| 3,758,811 | 9/1973 | Wong | 315/3.6 |
| 3,761,760 | 9/1973 | Harper et a. | 315/3.6 |

*Primary Examiner*—Saxfield Chatmon, Jr.
*Attorney, Agent, or Firm*—Ostrolenk, Faber, Gerb & Soffen

[57] ABSTRACT

A traveling-wave tube has a slow wave circuit consisting of a constant phase velocity section extending from the electron gun side of the tube, and a phase velocity tapering section extending from the collector side of the tube in which the phase velocity of the electromagnetic wave is lower than in the constant phase velocity section. An attenuator is located at about the center of the constant phase velocity section. The ratio of the length of the phase velocity tapering section to the distance between the end of the attenuator which faces the collector side of the tube and the electron gun side end of the phase velocity tapering section is equal to, or less than 0.4.

5 Claims, 4 Drawing Figures

TRAVELING-WAVE TUBE HAVING PHASE VELOCITY TAPERING MEANS IN A SLOW-WAVE CIRCUIT

BACKGROUND OF THE INVENTION

The present invention relates to a traveling-wave tube, and more particularly, to a traveling-wave tube in which the phase velocity of the traveling electromagnetic wave in the proximity of the collector, or output end, of the slow-wave circuit is made lower than the phase velocity in the proximity of the electron gun or input end, so that the interaction between the electron beam and the electromagnetic wave may be intensified to enhance efficiency.

As is well-known, in a traveling-wave tube, interaction is effected between an electromagnetic wave propagating through a slow-wave circuit of periodic structure at a phase velocity in the direction of the tube axis of about 1/10 of the velocity of light and the electron beam drifting in the direction of the tube axis along the slow-wave circuit at a synchronized velocity that is slightly greater than the phase velocity of the electromagnetic wave. As a result, kinetic energy of the electron beam is transferred to the electromagnetic energy to amplify the electromagnetic wave.

However, the electron beam is slowed down as its kinetic energy is transferred to the electromagnetic wave through the above-mentioned interaction. Consequently, the constant phase velocity of the wave determined by the structural period of the slow-wave circuit and the electron beam velocity fallout of the required synchronism, and the electromagnetic wave energy and the conversion efficiency is limited. In order to remove this limitation on conversion efficiency in a traveling-wave tubes and like electron tubes in which kinetic energy of an electron beam is converted into electromagnetic wave energy, it is known that the phase velocity of the electromagnetic wave can be decreased to match the electron beam that has been slowed down as a result of the interaction with the electromagnetic wave to again maintain the required synchronism therebetween and thereby enhance the conversion efficiency. This approach makes use of the fact that the phase velocity of an electromagnetic wave propagating through a slow-wave circuit having a periodic structure is determined by the structural period, and the phase velocity is lowered as the structural period is reduced near the output end of the slow wave circuit where the interaction between the electron beam and the electromagnetic wave is remarkably intensified. A tube having this structure is described in the article by J. E. Rowe and C. A. Brackett entitled "Velocity Tapering in Microwave Amplifiers" published in August 1965 issue of the IEEE TRANSACTIONS ON ELECTRON DEVICES, pp. 441–447. In such conventional traveling-wave tubes having a phase velocity tapering section in the slow-wave circuit, for the purpose of preventing an oscillation phenomenon caused by mismatching at the input and output ends of the slow-wave circuit, it is a common practice to provide an attenuator made of electromagnetic wave absorber material in proximity to the center of the slow-wave circuit.

However, sufficient consideration has not been given to the positioning of the attenuator. In more detail, in the prior art examples, the ratio of the length of the phase velocity tapering section to the length of the slow wave circuit from the collector side end of the attenuator (the terminal end of the attenuator) to the electron gun side end of the phase velocity tapering section was normally selected equal to or larger than 1.0. This is described in Calculation of Coupled Cavity TWT Performance in October 1975 issue of the IEEE TRANSACTIONS ON ELECTRON DEVICES, pp. 880–890. An example of a ratio as small as 0.52 is found in J. A. Christensen and Dr. I. Tammaru "Development of a 200W CW High Efficiency Traveling-Wave Tube at 12 GHz", NASA-CR-134734, pp. 22–23. Consequently, the interaction between an electron beam and an electromagnetic wave is subjected to the adverse effects of the attenuator, and so, a desirably high conversion efficiency can not be obtained.

Therefore, one object of the present invention is to provide a traveling-wave tube having high stability and high efficiency in which the adverse effect of an attenuator upon the conversion efficiency has been obviated by appropriately selecting the ratio of the length of the phase velocity tapering section to the length of the slow wave circuit from the collector side end of the attenuator to the electron-gun-side end of the phase velocity tapering section.

BRIEF DESCRIPTION OF THE PRESENT INVENTION

A traveling-wave tube according to the present invention is characterized in that the slow-wave circuit is formed of a constant phase velocity section disposed close to the electron gun side of the tube for imparting a constant phase valocity to the electromagnetic wave propagating through the circuit, and a phase velocity tapering section disposed close to the collector side of the circuit for imparting a phase velocity lower than the constant phase velocity to said electromagnetic wave; and in that the ratio of the length of the phase velocity tapering section to the length between the collector side end of the attenuator for preventing an oscillation disposed approximately at the center of the slow-wave circuit and the electron-gun-side end of the phase velocity tapering section, is equal to or less 0.4.

The present invention is based on the recognition enhancement of the conversion efficiency of a traveling-wave tube is achieved not only by the appropriate selection of the length of the phase velocity tapering section and the ratio of the output-end phase velocity to the input-end phase velocity, but also by the appropriate positioning of the phase velocity tapering section relative to the attenuation. That is, the invention recognizes a critical ratio of the length of the phase velocity tapering section to the length between the collector end of the attenuator and the electron gun end of the phase velocity tapering section.

Conversion efficiency can be enhanced by the present invention for the following reasons.

It can be shown (See for example, O. Sauseng, "Efficiency Enhancement of Traveling-Wave Tubes By Velocity Resynchronization" MOGA68, pp. 16–20, VDE-Verlag-GmbH) that for the most efficient operation of traveling-wave tubes, the electron gun end and the collector end of the phase velocity tapering section should be set at the position where the saturated output power could be obtained if the phase velocity tapering section is not provided.

While the most appropriate length of the phase velocity tapering section varies depending upon the individual traveling-wave tube and must be determined according to practical numerical calculations, it has become apparemnt as a result of various numerical calculations that within the normal operating parameter region the optimum value exists in the following region:

$$1 \leqq \beta e\, CZ_2 \leqq 3 \quad (1)$$

where $\beta e$ represents the phase velocity of a wave having the same velocity as the initial velocity of the electron beam, C represents a gain parameter of the traveling-wave tube, and $Z_2$ represents the length of the phase velocity tapering section. In other words the center term in Formula (1) represents, a normalized length of $Z_2$. In addition, it is also a well-known fact that in order that the interaction between the electron beam and the electromagnetic wave is not adversely affected by the attenuator, the gain corresponding to the length from the collector end of the attenuator to the position where the saturated output power can be obtained must necessarily be 26 dB or more. Furthermore, it is experimentally confirmed that in order to prevent an oscillation phenomenon caused by discontinuity of the circuit at the electron bweam end of the phase velocity tapering section the gain at this portion must be 50 dB or less. Accordingly, the gain BC $(\beta e/2\pi)Z_1$ corresponding to the section of distance $Z_1$ from the collector end ot the attenuator to the position where the saturated output power can be obtained (For the above mentioned reasons this position should be selected to the electron gun end of the phase velocity tapering section), is subjected to limitation as represented by the following formula:

$$50 \geqq BC(\beta e/2\pi)Z_1 \geqq 26 \quad (2)$$

where B represents a growing wave parameter which is normally about 32 dB.

From Formulae (1) and (2), the following relation is obtained:

$$Z_2/Z_1 \leqq 3 \cdot B/163 = 96/163 < 0.6 \quad (3)$$

Formula (3) above represents the condition which must be satisfied in a traveling-wave tube in which the slow-wave circuit has the phase velocity tapering section, if the magnitude of the saturated output power is not to be reduced by the attenuator so that a high conversion efficiency can be obtained. This formula shows that the ratio of the length of the phase velocity tapering section to the length from the collector end of the attenuator to the electron gun end of the phase velocity tapering section must be smaller than 0.6.

The change of the conversion efficiency in the region of $Z_2/Z_1$ as represented by Formula (3) has been checked on the basis of the large signal theory for a traveling-wave tube by employing a deformable disk model of an electron beam. In this study, parameters other than $Z_2Z_1$ were adjusted so as to afford the maximum conversion efficiency. FIG. 1 shows the variation as a function of $Z_2Z_1$ of the ratio $P_o/P_u$ where $P_o$ is output power for a tube using the phase velocity tapering section and $P_u$ is output power for a tube not using the phase velocity tapering section. From this diagram it is seen that as $Z_2Z_1$ is reduced from the proximity of 0.6, the conversion efficiency improves, and the degree of improvement becomes very remarkable when $Z_2/Z_1$ is reduced to 0.4 or less. In addition, for the condition that oscillation phenomenon will not occur and stable operation can be effected, the lower limit of $Z_2/Z_1$ is determined by Formulae (1) and (2), so that the optimum condition for $Z_2/Z_1$ is represented by the following formula:

$$0.1 < Z_2/Z_1 \leqq 0.4 \quad (4)$$

In other words, it is very important for enhacement of the converson efficiency to select the ratio of the length of the phase velocity tapering section to the length, from the collector side end of the attenuator to the electron beam end of the phase velocity tapering section, larger than 0.1 an equal to or less than 0.4.

A preferred embodiment of the present invention will be explained hereafter as supplied to a helix type traveling-wave tube.

DETAILED DESCRIPTION OF THE DRAWINGS

Figure 2:
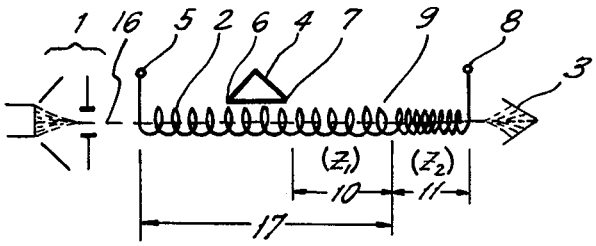
FIG. 2 is a schematic view of a traveling-wave tube according to the present invention, in which the slow-wave circuit is made of a helical wire and has a phase velocity tapering section.

Referring to the embodiment of FIG. 2, electrons are emitted from an electron gun 1 and shaped into an electron beam 16 which is directed along the axis of the slow-wave circuit. The electron beam 16 is subjected to interaction with an electromagnetic wave propagating through slow-wave circuit 2 is eventually collected by a collector 3. The electromagnetic wave is applied to an input end 5 of the slow-wave circuit 2, and absorbs energy from the electron beam and is amplified while propagating through the slow-wave circuit 2, and the wave is delivered from an output end 8. The slow-wave circuit 2 is divided into a section 17, designed to give a constant phase velocity and extending from the input end 5 to a position 9, and phase velocity tapering section 11 designed to give a smaller phase velocity than the constant phase velocity and extending from the position 9 to the output end 8. The structural period of the slow-wave circuit in the phase velocity tapering section 11 is smaller than the structural period in the section 17. In the proximity of the election gun end 9 of the phase velocity tapering section 11 the structural period of the slow-wave circuit is tapered to avoid an abrupt change. An attenuator 4 is provided to prevent oscillation phenomenon caused by impedance mismatching at the input and output ends 5 and 8 of the slow wave circuit 2. While attenuator 4 gives a sufficient amount of attenuation to the electromagnetic wave propagating through the slow-wave circuit 2, it has no effect upon the modulation current of the electron beam. Therefore, after having passed through the attenuator 4 electromagnetic wave energy is induced in the circuit and the interaction between the electron beam and the electromagnetic wave is recommended. In a typical device made according to the invention, the normalized length $\beta e\, CZ_2$ of the phase velocity tapering section 11 is equal to 2.0, the gain corresponding to the length $Z_1$ of the section 10 extending from the collector side end 7 of the attenuator 4 to the beginning end 9 of the phase velocity tapering section 11 is 30 dB, and $Z_2/Z_1$ is 0.34. The electron gun end 9 of the phase velocity tapering section 11 i at the position where saturated output power can be obtained if the phase velocity tapering section 11 does not exist.

Figure 3:
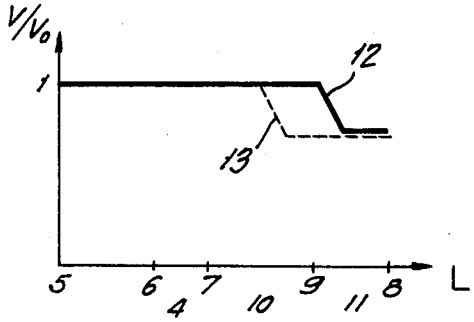
FIG. 3 is a diagram showing the variation of the phase velocity of the slow-wave circuit along the tube axis.

In FIG. 3, the abscissa shows the length L along the tune axis of the slow-wave circuit 2, and the ordinate shows the phase velocities V in the slow-wave circuit as normalized with respect to the phase velocity $V_0$ at the input end 5.

Curve 12 shows the variation of the phase velocity in a traveling wave tube made according to the present invention, whereas curve 13 shows an example of a prior art traveling wave tube in which a low conversion efficiency is obtained. The numerals marked along the abscissa in FIG. 3 correspond to the numerals in FIG. 2. The valve of $V/V_0$ in the section from the input end 5 to the electron gun end 9 of the phase velocity tapering section 11 is equal to 1, but in the phase velocity tapering section 11, the value of $V/V_o$ is smaller than 1 since the structural period is smaller. The value $V/V_o$ at the output end 8 is equal to 0.8. In addition, in the proximity of the position 9, the phase velocity is also varied in a tapering form, since the structural period is tapered. In the case of curve 12, the ratio of the length $Z_2$ of the section 11 to the length $Z_1$ of the section 10 is equal to 0.34, but in the case of curve 13 this ratio is larger than 1.0.

Figure 4:
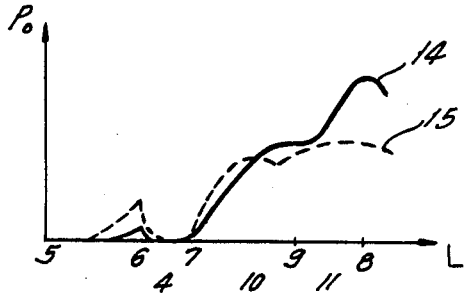
FIG. 4 is a diagram showing the power increase along the tube axis.

The abscissa in FIG. 4 represents length along the tube axis of FIG. 2, similarly to FIG. 3, and the numerals in FIG. 4 correspond to like numerals in FIGS. 2 and 3. The ordinate in FIG. 4 represents the electromagnetic wave power $P_o$.

Figure 1:
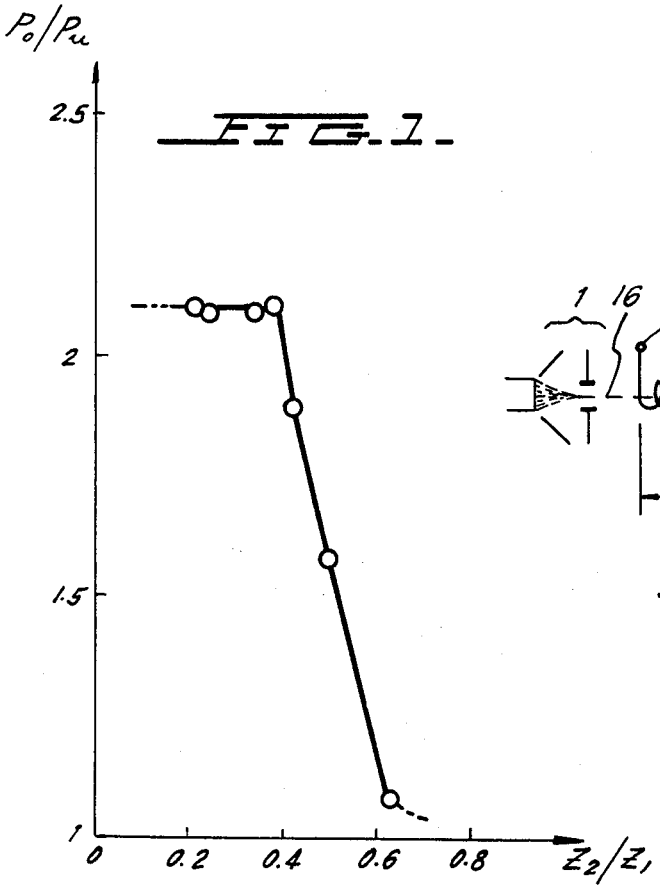
FIG. 1 is a diagram showing improvements in the conversion efficiency as a function of the ratio $Z_2/Z_1$.

Curve 14 in FIG. 4 shows a variation of the power $P_o$ along the tube axis of a traveling-wave tube according to the present invention, which corresponds to the example represented by curve 12 in FIG. 3. Curve 15 corresponds to the prior art example represented by curve 13 in FIG. 3. After the power $P_o$ has been once attenuated by the attenuator 4, again it begins to be amplified and at the beginning end 9 of the phase velocity tapering section 11 it reaches saturation. However, since the phase velocity of the electromagnetic wave is lowered at location 9, the electron beam and the electromagnetic wave again recover their synchronism, so that the electromagnetic wave power is increased and it again reaches a higher valve saturation at the output end 8. In the case of the prior art example shown by curve 15, since the length $Z_1$ between the beginning end 9 of the phase velocity tapering section 11 and the collector side end 7 of the attenuator 4 is too small and the length $Z_2$ of the phase velocity tapering section 11 is too large, the ratio $Z_2/Z_1$ becomes larger than 1.0, resulting in a low conversion efficiency. In the case of the example shown by curve 14, the output power, that is, the conversion efficiency, has been increased by a factor of 1.6 in comparison to a traveling-wave tube having a slow-wave circuit of uniform structural period. Although this improvement in the conversion efficiency is somewhat lower than the values shown in FIG. 1, the effect of the improvement is still substantial. On the other hand, in the case of the prior art example shown by curve 15, the output power is almost the same as that of a traveling-wave tube having a slow-wave circuit of uniform structural period. In the latter case, investigating the velocity ditribution of the electron beam incident onto the collector 3 by varying the potential of the collector 3, it has been observed that despite almost the same output power as the case of uniform structural period, lower velocity electrons exist and thus the velocity distribution is broadened. This shows that the conversion efficiency is adversely affected by the attenuator 4. As will be seen from the above the present invention, enables the conversion efficiency to be greatly improved without being adversely affected by the attenuator 4.

It will be apparent that the present invention is applicable not only to the illustrated traveling-wave tube, but also to any traveling-wave tube having phase velocity tapering means which reduces the phase velocity of the electromagnetic wave in the proximity of the output end of the slow-wave circuit, without relaying upon the variation of the structural period of the slow-wave circuit, or by employing another method and the variation of the structural period in combination. Furthermore, while the slow-wave circuit of the traveling-wave tube in the illustrated embodiment is made of a helical wire, the present invention is equally applicable to a traveling-wave tube employing a slow-vave circuit constructed of, for example, an array of coupled cavities.

What is claimed is:

1. A traveling-wave tune including an electron gun for providing a beam of electrons, a collector for collecting said electrons, a slow-wave circuit disposed midway between said electron gun and said collector for effecting interaction between the electron beam and an electromagnetic wave, an an attenuator provided along the slow-wave circuit; said slow-wave circuit having a constant phase velocity section disposed on the electron gun side of said slow-wave circuit for imparting a constant phase velocity to the electromagnetic wave propagating therethrough, and a phase velocity tapering section disposed on the collector side of said slow-wave circuit for imparting a smaller phase velocity than said constant phase velocity to said electromagnetic wave; the ratio of the length of said phase velocity tapering section to the length from the collector side end of said attenuator to the electron gun side end of said phase velocity tapering section being equal to or less than 0.4.

2. The traveling-wave tube of claim 1, wherein said ratio is larger than 0.1.

3. The traveling-wave tube of claim 2 wherein the electron gun side of said phase velocity tapering section is located at the position along said slow-wave circuit where a saturated output is obtained in a traveling-wave tube not provided with said phase velocity tapering section.

4. The traveling-wave tube of claim 3, wherein the slow-wave circuit of said traveling-wave tube consists of a helix.

5. The traveling-wave tube of claim 3, wherein the slow-wave circuit of said traveling wave tube consists of coupled cavities.

* * * * *